US006093076A

United States Patent [19]

Street

[11] Patent Number: 6,093,076

[45] Date of Patent: Jul. 25, 2000

[54] WATER PROPELLED TOY TORPEDO

[76] Inventor: Jason A Street, 851 S. Acacia Ave., Rialto, Calif. 92376

[21] Appl. No.: 09/265,340

[22] Filed: Mar. 9, 1999

[51] Int. Cl.[7] ..... A63H 23/00; A63H 23/02; A63H 23/04

[52] U.S. Cl. ..... 446/156; 446/161; 446/162; 446/165

[58] Field of Search ..... 446/153, 155, 446/156, 158, 160, 161, 162, 163, 164, 165

[56] References Cited

U.S. PATENT DOCUMENTS

| | | | |
|---|---|---|---|
| 2,903,822 | 9/1959 | Reid | 446/155 |
| 3,036,403 | 5/1962 | Presnell | 446/162 |
| 3,242,613 | 3/1966 | Schwartz | 446/162 |
| 3,418,751 | 12/1968 | Mabuchi | 446/162 |
| 3,419,997 | 1/1969 | Owbridge | 446/162 |
| 3,450,908 | 6/1969 | Mabuchi | 446/163 X |
| 3,619,938 | 11/1971 | Tong | 446/161 |
| 4,826,465 | 5/1989 | Fleischmann | 446/162 |
| 5,514,023 | 5/1996 | Warner | 446/453 X |

*Primary Examiner*—D. Neal Muir
*Attorney, Agent, or Firm*—Goldstein & Canino

[57] ABSTRACT

A water propelled toy torpedo including a main housing having an open forward end and an open rearward end. A battery pack is disposed within the main housing inwardly of the open forward end. A battery cap is disposed within the open forward end of the housing in communication with the battery pack. A forward portion has a micro switch extending forwardly therefrom. A motor is disposed within the open rearward end of the main housing. The motor is in communication with the battery cap. The motor has a shaft extending rearwardly therefrom whereby an outer end of the shaft is disposed outwardly with respect to the open rearward end of the main housing. A transparent cap portion couples with the open forward end of the main housing. The cap portion has an open inner end and a closed arcuate outer end. The arcuate outer end has a post extending inwardly from an inner surface thereof. An inner end of the post selectively contacts the micro switch of the battery cap to facilitate activation of the torpedo. A tail portion couples with the open rearward end of the main housing. The tail portion has an open inner cavity and an open outer cavity. The open inner and outer cavity's are separated by a central wall. The open outer cavity has a propeller disposed therein. The propeller has a shaft portion extending through the central wall into the open inner cavity. An inner end of the shaft portion is coupled with the outer end of the shaft of the motor.

10 Claims, 2 Drawing Sheets

WATER PROPELLED TOY TORPEDO

BACKGROUND OF THE INVENTION

The present invention relates to a water propelled toy torpedo and more particularly pertains to propelling through a body of water.

The use of water toys is known in the prior art. More specifically, water toys heretofore devised and utilized for the purpose of providing enjoyment in the water are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,274,223 to Morrison et al. discloses a water toy propelled by a jet of water. U.S. Pat. No. 5,415,153 to Johnson et al. discloses a pressurized air/water rocket and launcher. U.S. Pat. No. 4,179,841 to Kupperman et al. discloses a toy object that propels forward, submerges and surfaces. U.S. Pat. No. 3,935,665 to Tong discloses a submersible toy. U.S. Pat. No. 4,241,535 to Tsukuda discloses a submersible toy. U.S. Pat. No. Des. 258,226 to Strickland discloses the ornamental design for a simulative water toy.

While these devices fulfill their respective, particular objective and requirements, the aforementioned patents do not describe a water propelled toy torpedo for propelling through a body of water.

In this respect, the water propelled toy torpedo according to the present invention substantially departs from the conventional concepts and designs of the prior art, and in doing so provides an apparatus primarily developed for the purpose of propelling through a body of water.

Therefore, it can be appreciated that there exists a continuing need for new and improved water propelled toy torpedo which can be used for propelling through a body of water. In this regard, the present invention substantially fulfills this need.

SUMMARY OF THE INVENTION

In the view of the foregoing disadvantages inherent in the known types of water toys now present in the prior art, the present invention provides an improved water propelled toy torpedo. As such, the general purpose of the present invention, which will be described subsequently in greater detail, is to provide a new and improved water propelled toy torpedo and method which has all the advantages of the prior art and none of the disadvantages.

To attain this, the present invention essentially comprises a main housing having a cylindrical configuration. The main housing has an open forward end and a rearward end. The open forward and rearward ends each have external threads disposed therearound. The main housing has O-rings disposed within annular recesses inwardly of the external threads of the open forward and rearward ends. The external threads of the rearward end have drainage apertures therethrough. A battery pack is disposed within the main housing inwardly of the open forward end. A battery cap is disposed within the open forward end of the housing in communication with the battery pack. The battery cap has a forward portion extending outwardly of the open forward end of the main housing. The forward portion has a plurality of lights thereon. The forward portion has a micro switch extending forwardly therefrom. The battery cap has a female plug disposed therein. A motor is disposed within the open forward end of the main housing. The motor has a female plug disposed therein. The motor has a shaft extending rearwardly therefrom whereby an outer end of the shaft is disposed outwardly with respect to the open rearward end of the main housing. A connection cord extends between the battery cap and the motor. The connection cord has male plugs disposed on opposing ends thereof for being received within the female plugs of the battery cap and the motor whereby current is carried from the battery cap to the motor. A transparent cap portion couples with the open forward end of the main housing. The cap portion has an open inner end and a closed arcuate outer end. The open inner end is internally threaded for mating with the external threads of the open forward end of the main housing. The arcuate outer end has a post extending inwardly from an inner surface thereof. The post has ballast rings disposed thereon. The ballast rings are contained by a washer. An inner end of the post selectively contacts the micro switch of the battery cap to facilitate activation of the torpedo. A tail portion couples with the rearward end of the main housing. The tail portion has an open inner cavity and an open outer cavity. The open inner and outer cavity's are separated by a central wall. The open inner cavity is internally threaded for mating with the external threads on the rearward end of the main housing. The open outer cavity has a propeller disposed therein. The propeller has a shaft portion extending through the central wall into the open inner cavity. An inner end of the shaft portion is coupled with the outer end of the shaft of the motor by a nylon coupler. The open outer cavity has a protective screen secured within an outer portion thereof. The tail portion has a plurality of circumferentially disposed fins extending outwardly from an outer surface thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved water propelled toy torpedo which has all the advantages of the prior art water toys and none of the disadvantages.

It is another object of the present invention to provide a new and improved water propelled toy torpedo which may be easily and efficiently manufactured and marketed.

It is a further object of the present invention to provide a new and improved water propelled toy torpedo which is of durable and reliable construction.

An even further object of the present invention is to provide a new and improved water propelled toy torpedo which is susceptible of a low cost of manufacture with regard to both materials and labor, and which accordingly is then susceptible of low prices of sale to the consuming public, thereby making such a water propelled toy torpedo economically available to the buying public.

Even still another object of the present invention is to provide a new and improved water propelled toy torpedo for propelling through a body of water.

Lastly, it is an object of the present invention to provide a new and improved water propelled toy torpedo including a main housing having a cylindrical configuration. The main housing has an open forward end and an open rearward end. A battery pack is disposed within the main housing inwardly of the open forward end. A battery cap is disposed within the open forward end of the housing in communication with the battery pack. The battery cap has a forward portion extending outwardly of the open forward end of the main housing. The forward portion has a micro switch extending forwardly therefrom. A motor is disposed within the open forward end of the main housing. The motor is in communication with the battery cap. The motor has a shaft extending rearwardly therefrom whereby an outer end of the shaft is disposed outwardly with respect to the open rearward end of the main housing. A transparent cap portion couples with the open forward end of the main housing. The cap portion has an open inner end and a closed arcuate outer end. The arcuate outer end has a post extending inwardly from an inner surface thereof. An inner end of the post selectively contacts the micro switch of the battery cap to facilitate activation of the torpedo. A tail portion couples with the open rearward end of the main housing. The tail portion has an open inner cavity and an open outer cavity. The open inner and outer cavity's are separated by a central wall. The open outer cavity has a propeller disposed therein. The propeller has a shaft portion extending through the central wall into the open inner cavity. An inner end of the shaft portion is coupled with the outer end of the shaft of the motor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
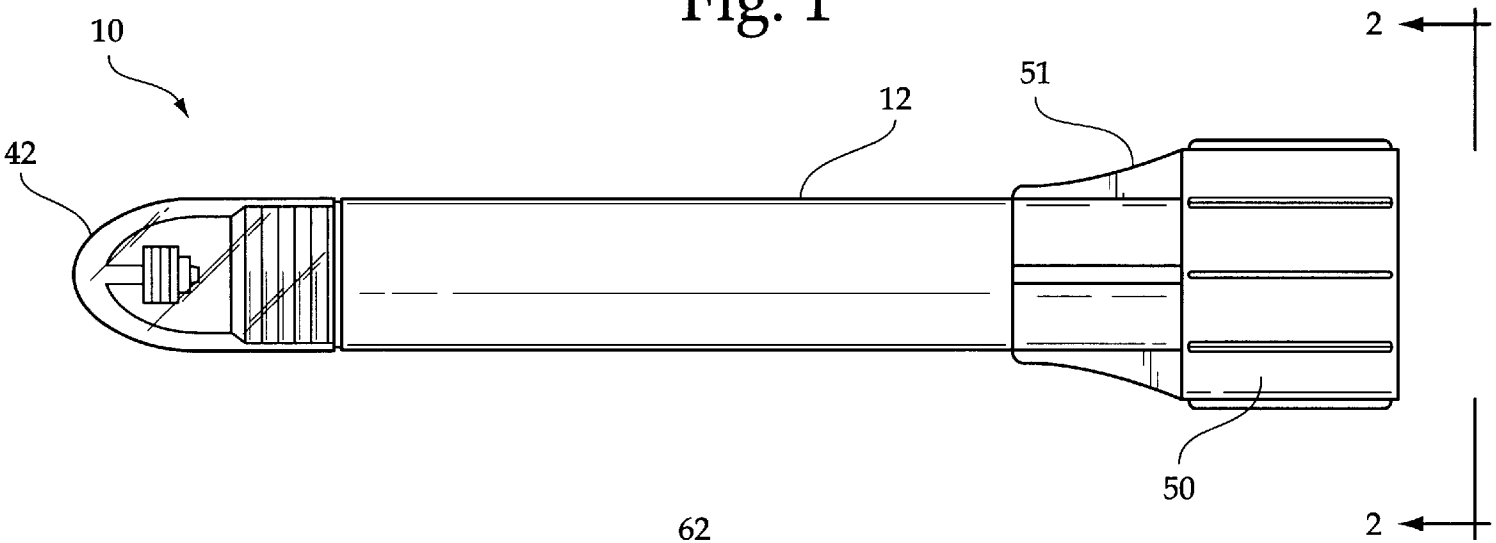
FIG. 1 is a side view of the preferred embodiment of the water propelled toy torpedo constructed in accordance with the principles of the present invention.
Figure 2:
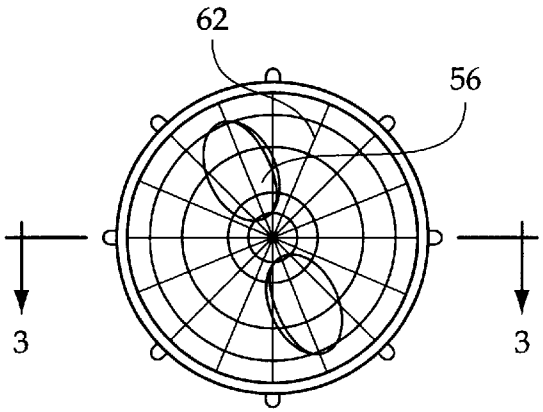
FIG. 2 is a rear view of the present invention as taken along line 2—2 of FIG. 1.
Figure 3:
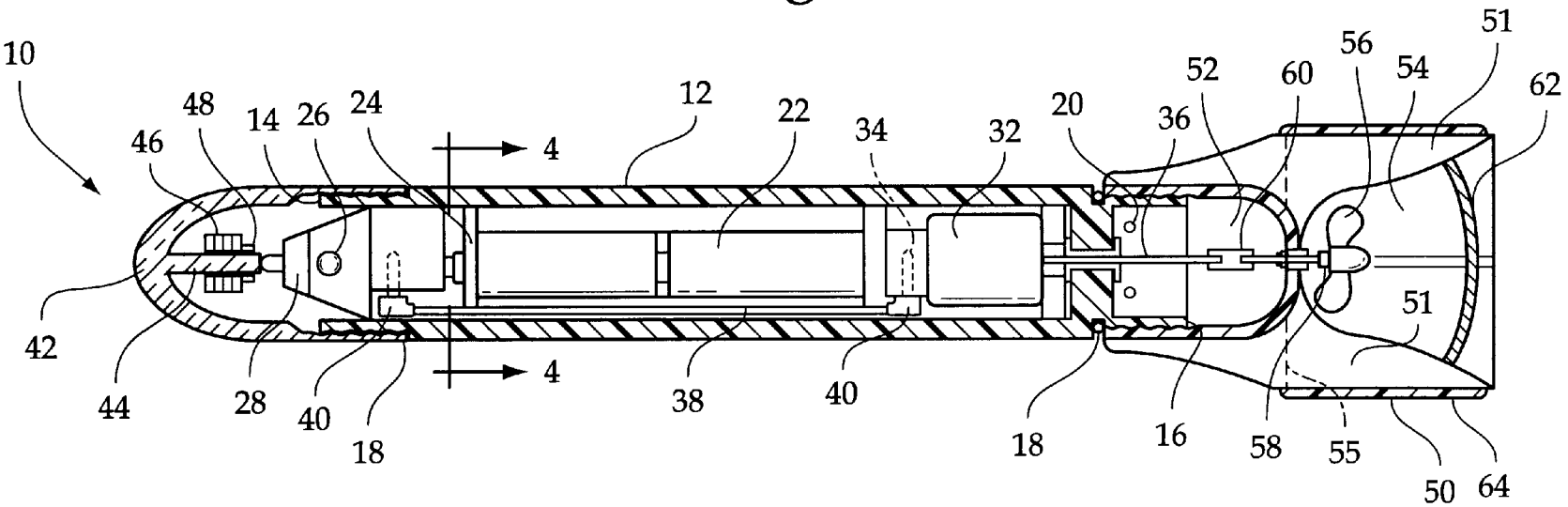
FIG. 3 is a cross-sectional view of the present invention as taken along line 3—3 of FIG. 2.
Figure 4:
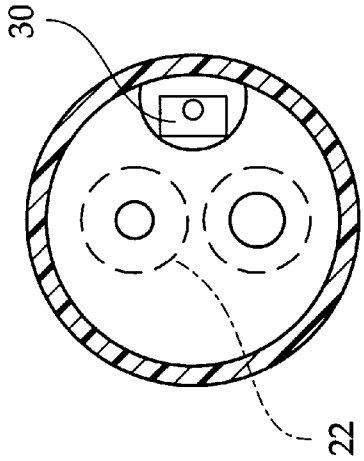
FIG. 4 is cross-sectional view of the present invention as taken along line 4—4 of FIG. 3.

With reference now to the drawings, and in particular, to FIGS. 1 through 4 thereof, the preferred embodiment of the new and improved water propelled toy torpedo embodying the principles and concepts of the present invention and generally designated by the reference number 10 will be described.

Specifically, it will be noted in the various Figures that the device relates to a water propelled toy torpedo for propelling through a body of water. In its broadest context, the device consists of a main housing, a battery pack, a battery cap, a motor, a connection cord, a cap portion, and a transparent tail portion. Such components are individually configured and correlated with respect to each other so as to attain the desired objective.

The main housing 12 has a cylindrical configuration. The main housing 12 has an open forward end 14 and an open rearward end 16. The open forward and rearward ends 14,16 each have external threads disposed therearound. The main housing 12 has O-rings 18 disposed within annular recesses inwardly of the external threads of the open forward and rearward ends 14,16. The external threads of the open rearward end 16 have drainage apertures 20 therethrough.

The battery pack 22 is disposed within the main housing 12 inwardly of the open forward end 14.

The battery cap 24 is disposed within the open forward end 14 of the housing 12 in communication with the battery pack 22. The battery cap 24 has a forward portion extending outwardly of the open forward end 14 of the main housing 12. The forward portion has a plurality of lights 26 thereon. The forward portion has a micro switch 28 extending forwardly therefrom. The battery cap 24 has a female plug 30 disposed therein.

The motor 32 is disposed within the open rearward end 16 of the main housing 12. The motor 32 is positioned within open rearward end 16 by passing through the open forward end 14. The motor 32 has a female plug 34 disposed therein. The motor 32 has a shaft 36 extending rearwardly therefrom whereby an outer end of the shaft 36 is disposed outwardly with respect to the open rearward end 16 of the main housing 12.

The connection cord 38 extends between the battery cap 24 and the motor 32. The connection cord 38 has male plugs 40 disposed on opposing ends thereof for being received within the female plugs 30,34 of the battery cap 24 and the motor 32 whereby current is carried from the battery cap 24 to the motor 32.

The transparent cap portion 40 couples with the open forward end 14 of the main housing 12. The cap portion 40 has an open inner end and a closed arcuate outer end 42. The open inner end is internally threaded for mating with the external threads of the open forward end 14 of the main housing 12. The arcuate outer end 42 has a post 44 extending inwardly from an inner surface thereof. The post 44 has ballast rings 46 disposed thereon. The ballast rings 46 are contained by a washer 48. An inner end of the post 48 selectively contacts the micro switch 28 of the battery cap 24 to facilitate activation of the torpedo 10. By turning the cap portion 40 clockwise, the post 48 will press up against the micro switch 28 and seal the cap portion 40 against the O-ring 18. This will activate the device 10. By reversing the procedure and turning the cap portion 40 counter-clockwise will deactivate the device 10.

The tail portion 50 couples with the open rearward end 16 of the main housing 12. The tail portion 50 is formed by four stabilizing fins 51. The tail portion 50 has an open inner cavity 52 and an open outer cavity 54. The open inner and outer cavity's 52,54 are separated by a central wall 55. The open inner cavity 52 is internally threaded for mating with the external threads on the open rearward end 16 of the main housing 12. The open outer cavity 54 has a propeller 56 disposed therein. The propeller 56 has a shaft portion 58 extending through the central wall 55 into the open inner cavity 52. An inner end of the shaft portion 58 is coupled with the outer end of the shaft 36 of the motor 32 by a nylon coupler 60. The open outer cavity 54 has a protective screen 62 secured within an outer portion thereof. The tail portion 50 has a plurality of circumferentially disposed fins 64 extending outwardly from an outer surface thereof. To drain the tail portion 50, simply turn the tail portion 50 until the drainage apertures 20 are visible, and then gently shake the device 10 to dispense the water.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A water propelled toy torpedo for propelling through a body of water comprising, in combination:

a main housing having a cylindrical configuration, the main housing having an open forward end and an open rearward end, the open forward and rearward ends each having external threads disposed therearound, the main housing having O-rings disposed within annular recesses inwardly of the external threads of the open forward and rearward ends, the external threads of the open rearward end having drainage apertures therethrough;

a battery pack disposed within the main housing inwardly of the open forward end;

a battery cap disposed within the open forward end of the housing in communication with the battery pack, the battery cap having a forward portion extending outwardly of the open forward end of the main housing, the forward portion having a plurality of lights thereon, the forward portion having a micro switch extending forwardly therefrom, the battery cap having a female plug disposed therein;

a motor disposed within the open rearward end of the main housing, the motor having a female plug disposed therein, the motor having a shaft extending rearwardly therefrom whereby an outer end of the shaft is disposed outwardly with respect to the open rearward end of the main housing;

a connection cord extending between the battery cap and the motor, the connection cord having male plugs disposed on opposing ends thereof for being received within the female plugs of the battery cap and the motor whereby current is carried from the battery cap to the motor;

a transparent cap portion coupling with the open forward end of the main housing, the cap portion having an open inner end and a closed arcuate outer end, the open inner end being internally threaded for mating with the external threads of the open forward end of the main housing, the arcuate outer end having a post extending inwardly from an inner surface thereof, the post having ballast rings disposed thereon, the ballast rings being contained by a washer, an inner end of the post selectively contacting the micro switch of the battery cap to facilitate activation of the torpedo;

a tail portion coupling with the open rearward end of the main housing, the tail portion having an open inner cavity and an open outer cavity, the open inner and outer cavity's being separated by a central wall, the open inner cavity being internally threaded for mating with the external threads on the open rearward end of the main housing, the open outer cavity having a propeller disposed therein, the propeller having a shaft portion extending through the central wall into the open inner cavity, an inner end of the shaft portion being coupled with the outer end of the shaft of the motor by a nylon coupler, the open outer cavity having a protective screen secured within an outer portion thereof, the tail portion having a plurality of circumferentially disposed fins extending outwardly from an outer surface thereof.

2. A water propelled toy torpedo for propelling through a body of water comprising, in combination:

a main housing having a cylindrical configuration, the main housing having an open forward end and an open rearward end;

a battery pack disposed within the main housing inwardly of the open forward end;

a battery cap disposed within the open forward end of the housing in communication with the battery pack, the battery cap having a forward portion extending outwardly of the open forward end of the main housing, the forward portion having a micro switch extending forwardly therefrom;

a motor disposed within the open forward end of the main housing, the motor being in communication with the battery cap, the motor having a shaft extending rearwardly therefrom whereby an outer end of the shaft is disposed outwardly with respect to the open rearward end of the main housing;

a transparent cap portion coupling with the open forward end of the main housing, the cap portion having an open inner end and a closed arcuate outer end, the arcuate outer end having a post extending inwardly from an inner surface thereof, an inner end of the post selectively contacting the micro switch of the battery cap to facilitate activation of the torpedo;

a tail portion coupling with the open rearward end of the main housing, the tail portion having an open inner cavity and an open outer cavity, the open inner and outer cavity's being separated by a central wall, the open outer cavity having a propeller disposed therein, the propeller having a shaft portion extending through the central wall into the open inner cavity, an inner end of the shaft portion being coupled with the outer end of the shaft of the motor.

3. The water propelled toy torpedo as set forth in claim 2 wherein the open forward and rearward ends each having external threads disposed therearound, the main housing having O-rings disposed within annular recesses inwardly of the external threads of the open forward and rearward ends.

4. The water propelled toy torpedo as set forth in claim 3 wherein the external threads of the open rearward end have drainage apertures therethrough.

5. The water propelled toy torpedo as set forth in claim 2 wherein the forward portion of the battery cap has a plurality of lights thereon.

6. The water propelled toy torpedo as set forth in claim 2 and further including a connection cord extending between the battery cap and the motor, the connection cord having male plugs disposed on opposing ends thereof for being received within female plugs of the battery cap and the motor whereby current is carried from the battery cap to the motor.

7. The water propelled toy torpedo as set forth in claim 2 wherein the post of the cap portion has ballast rings disposed thereon, the ballast rings being contained by a washer.

8. The water propelled toy torpedo as set forth in claim 2 wherein the inner end of the shaft portion is coupled with the outer end of the shaft of the motor by a nylon coupler.

9. The water propelled toy torpedo as set forth in claim 2 wherein the open outer cavity of the tail portion has a protective screen secured within an outer portion thereof.

10. The water propelled toy torpedo as set forth in claim 2 wherein the tail portion has a plurality of circumferentially disposed fins extending outwardly from an outer surface thereof.

* * * * *